US010053272B2

(12) United States Patent
Doherty et al.

(10) Patent No.: US 10,053,272 B2
(45) Date of Patent: Aug. 21, 2018

(54) CONSUMER PRODUCT PACKAGE

(71) Applicant: The Gillette Company, Boston, MA (US)

(72) Inventors: Robert Charles Doherty, Braintree, MA (US); Richard Kevin Sennett, Abington, MA (US); Shu Chen, Long Grove, IL (US)

(73) Assignee: The Gillette Company LLC, Boston, MA (US)

( * ) Notice: Subject to any disclaimer, the term of this patent is extended or adjusted under 35 U.S.C. 154(b) by 574 days.

(21) Appl. No.: 14/625,727

(22) Filed: Feb. 19, 2015

(65) Prior Publication Data

US 2016/0244198 A1 Aug. 25, 2016

(51) Int. Cl.
*B65D 1/34* (2006.01)
*B65D 73/00* (2006.01)
*B65D 8/00* (2006.01)

(52) U.S. Cl.
CPC ..... *B65D 73/0092* (2013.01); *B65D 11/02* (2013.01)

(58) Field of Classification Search
CPC ..... B65D 1/36; B65D 1/40
USPC ..... 220/608, 675, 631, 636; 206/216, 223, 206/228, 351–360, 461–471, 765; D9/415, 425, 735, 736, 748, 749
See application file for complete search history.

(56) References Cited

U.S. PATENT DOCUMENTS

| | | | | |
|---|---|---|---|---|
| 7,172,069 | B2 * | 2/2007 | Coffin | A45D 27/225 206/208 |
| 8,083,058 | B2 | 12/2011 | Marcinkowski et al. | |
| D661,180 | S | 6/2012 | Marcinkowski et al. | |
| D662,811 | S | 7/2012 | Marcinkowski | |
| 2003/0062281 | A1 * | 4/2003 | Giard, Jr. | A61M 25/002 206/364 |
| 2006/0282045 | A1 * | 12/2006 | Wilkinson | A61B 5/417 604/198 |
| 2009/0321292 | A1 * | 12/2009 | Prudden, Jr. | B65D 1/30 206/354 |
| 2011/0290688 | A1 | 12/2011 | Marcinkowski et al. | |

* cited by examiner

*Primary Examiner* — Steven A. Reynolds
*Assistant Examiner* — Javier A Pagan
(74) *Attorney, Agent, or Firm* — Kevin C. Johnson

(57) ABSTRACT

A consumer product package comprising a tub comprising a base and a perimeter wall defining a cavity, the base comprising at least two projections extending from the base within the cavity, the at least two projections spaced apart from the perimeter wall; and a consumer product disposed within the cavity such that each of the at least two projections define a recessed portion to receive the consumer product, wherein the base comprises a secondary projection having a height different than a height of each of the at least two projections, the secondary projection free of contact from the consumer product.

10 Claims, 19 Drawing Sheets

CONSUMER PRODUCT PACKAGE

FIELD OF THE INVENTION

The present invention relates to display packages for consumer products.

BACKGROUND OF THE INVENTION

Blister-type packages are popular for storing and displaying articles for sale. The two primary components of a blister pack are the cavity or pocket made from a formable material (e.g., plastic) and a lid (e.g., paperboard or plastic). The formed cavity or pocket contains the product and the lid seals the product within the cavity. Other types of blister packs may consist of carded packages where the products are contained between a paperboard card and clear pre-formed plastic (e.g., polyvinylchloride). The consumer can easily examine the product through the transparent plastic. The plastic shell is vacuum-formed around a mold so it can contain the item snugly. The card may be brightly colored and designed depending on the item inside, and the pre-formed plastic is affixed to the card using heat and pressure to activate an adhesive (heat seal coating) on the blister card. The adhesive is strong enough so that the pack may hang on a peg, but weak enough so that the package can be easily opened. The card may also have a perforated window for access. A more secure package is known as a clamshell. It is often used to deter package pilferage for small high-value items such as consumer electronics. It consists of either two pre-formed plastic sheets or one sheet folded over onto itself and fused at the edges. They are usually designed to be difficult to open by hand so as to deter tampering. A pair of scissors or a sharp knife is often required to open them. Care must be used to safely open some of these packages.

Blister packs are typically thermoformed. Thermoforming is a manufacturing process where a plastic sheet is heated to a pliable forming temperature, formed to a specific shape in a mold, and trimmed to create a usable product. The sheet (or film when referring to thinner gauges and certain material types), is heated in an oven to a high-enough temperature that it can be stretched into or onto a mold and cooled to a finished shape. For high-volume applications, very large production machines are utilized to heat and form the plastic sheet and trim the formed parts from the sheet in a continuous high-speed process, and can produce many thousands of finished parts per hour depending on the machine and mold size and the size of the parts being formed.

Consumers have been demanding environmentally friendly changes in consumer product packaging, such as minimizing the use of plastic and other non renewable materials. Many consumers are concerned about the environmental impact of packaging. Researchers believe that global green initiatives have strongly influenced this consumer attitude. Researchers also believe this new consumer attitude that will continue to push packaging manufacturers into finding environmentally friendly packaging alternatives. Typical plastics take an extended period of time to compost (break down) in landfills. New environmentally friendly packaging materials are made from renewable materials that can be grown quickly (unlike most trees). Renewable materials may be recyclable and/or biodegradable. Several alternatives to plastics have been developed for thermoforming blister packs and trays, such as, paper board and renewable plant fiber. Despite the environmental advantages of these materials, current manufacturing processes (e.g., thermoforming) often limit the design and functionality of the final package. For example, the blister pack may require multiple angled sides because of draft angle requirements in order to remove the pack from a mold or tool during manufacturing. In another example, fiber trays with multiple draft angles and/or reverse draft foot areas are difficult to automatically feed on automated packaging machines, inter alia, because the surface energy of a fiber tray tends to stick the trays together as the walls of the fiber tray touch during stacking, thus, making it difficult to denest the trays. What is needed, then, is an environmentally friendly package that is cost-effective, easier and faster to manufacture, and/or easier and faster to assemble with more precision.

SUMMARY OF THE INVENTION

One aspect of the invention provides for a consumer product package comprising a tub comprising a base and a perimeter wall defining a cavity. The base comprises at least two projections extending from the base within the cavity, the at least two projections spaced apart from the perimeter wall. The consumer product package also comprises a consumer product disposed within the cavity such that each of the at least two projections define a recessed portion to receive the consumer product, wherein the base comprises a secondary projection having a height different than a height of each of the at least two projections, the secondary projection free of contact from the consumer product.

The foregoing aspect can include any one or more of the following features. The secondary projection can be integrally formed with the base. The secondary projection can comprise a plurality of secondary projections, a height of each of the secondary projections being equal in height. Each of the plurality of secondary projections can be spaced apart from one another. The tub can further comprise a top surface and the perimeter wall can comprise an exterior surface, the exterior surface comprising opposing side walls each forming a non-perpendicular angle with the top surface. The opposing side walls can be generally parallel. One interior side wall of the perimeter wall can be non-linear. The one side of the perimeter wall can comprise a recessed portion having a height lower than a top surface of the tub. Each interior side wall of the perimeter wall can be non-linear. The tub can be made from fiber.

In another aspect, the invention relates to a consumer product package comprising a tub comprising a top surface, a base, and a perimeter wall defining a cavity. The perimeter wall has at least one portion extending into the cavity, the at least one portion comprising a recessed portion, the recessed portion having a height lower than the top surface.

This aspect can include any or more of the following features. The recessed portion can be integrally formed with the perimeter wall. The base can comprise at least two projections extending from the base within the cavity, the at least two projections spaced apart from the perimeter wall, wherein the at least two projections can be integrally formed with the base. The consumer product package can also comprise a consumer product disposed within the cavity such that each of the at least two projections can define a recessed portion to receive the consumer product. The base can further comprise a secondary projection having a height different than a height of each of the at least two projections, the secondary projection can be free of contact from the consumer product and can be integrally formed with the base and the at least two projections. The secondary projection can comprise a plurality of secondary projections, a height of each of the secondary projections being equal in height. Each of the plurality of secondary projections can be spaced apart from one another. The perimeter wall can comprise an exterior surface, the exterior surface comprising opposing side walls each forming a non-perpendicular angle with the top surface. The opposing side walls can be generally parallel. One interior side wall of the perimeter wall can be non-linear. Each interior side wall of the perimeter wall can be non-linear. The tub can be made from fiber.

In yet another aspect, the invention relates to a method of processing tubs for consumer product package comprising manufacturing a plurality of integrally formed fiber tubs for a consumer product package, each fiber tub comprising a top surface, a base, and a perimeter wall defining a cavity, the perimeter wall comprising side walls, wherein each side wall is non-linear, one side wall has a reverse draft angle, and a portion of the fiber tub has a height elevated from the base and lower than a height of the top surface; and stacking the plurality of integrally formed fiber tubs, wherein a vertical surface of the portion of the fiber tub is free of contact from any portion of another of the plurality of integrally formed fiber tubs.

This aspect can include any the following features. The method of processing tubs can also include separating each of the plurality of integrally formed fiber tubs. The separating step can be accomplished via automation and free of human manipulation.

In still another aspect, the invention relates to a method of manufacturing a tub for a consumer product package comprising tilting a pair of toolings at an angle non parallel with horizontal; molding a fiber tub for a consumer product package between the pair of toolings, the fiber tub comprising a base and a perimeter wall defining a cavity, the perimeter wall comprising an exterior surface with side walls, wherein one of the side walls is formed with a reverse draft angle; and separating the fiber tub from the pair of toolings.

This aspect can include the following feature. The tilting of the pair of toolings can allow the separating of the side wall formed with the reverse draft angle to be separated vertically from the pair of toolings.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Except as otherwise noted, the articles "a," "an," and "the" mean "one or more."

Figure 1:
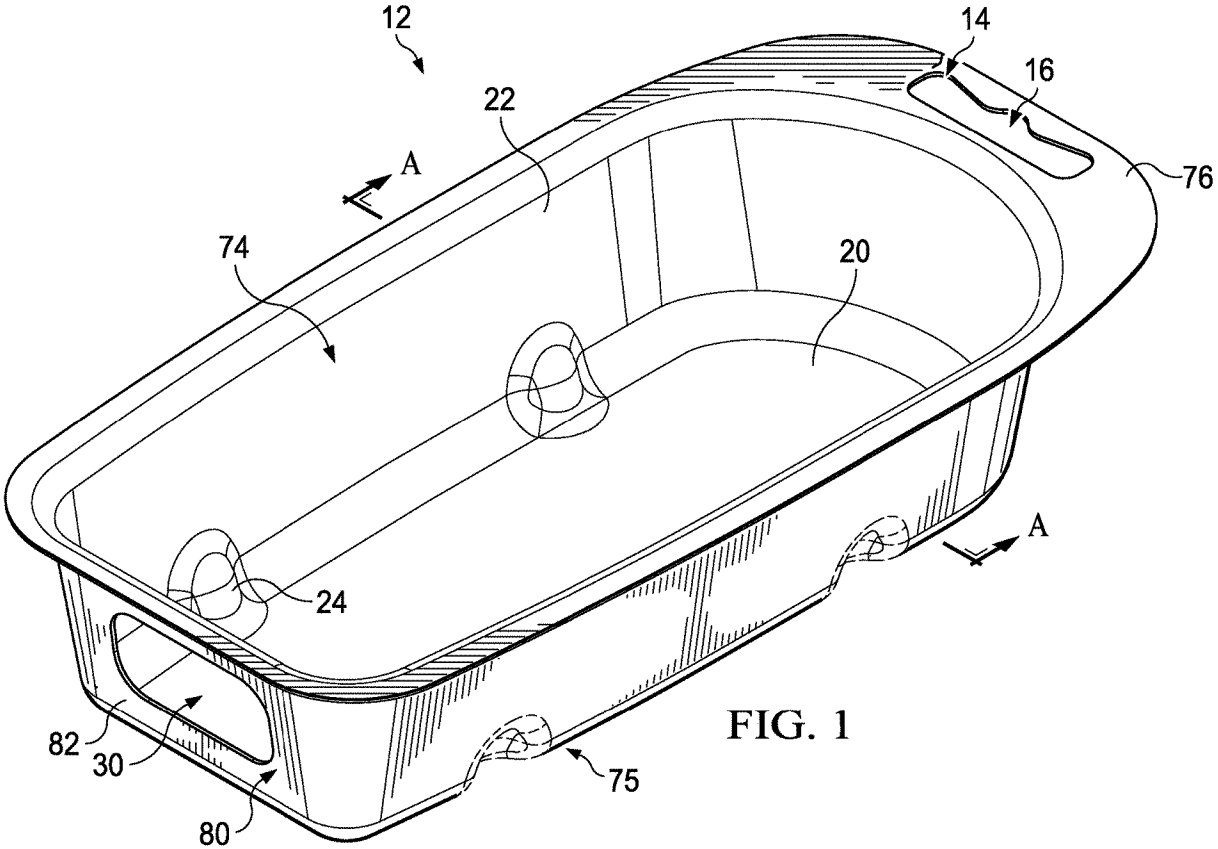
FIG. 1 is perspective view of a tub that may be incorporated into a consumer product package according to an embodiment of the invention.

Referring to FIG. 1, a perspective view of a tub 12 is shown. The tub 12 may have a base 20 and a perimeter wall 22 that defines a cavity 74. The base 20 may be generally flat. The perimeter wall 22 may have a plurality of nesting members 24. For example, the nesting members 24 may include recesses and/or protrusions located at a junction of the base 20 and the perimeter wall 22. The nesting members 24 may provide a gap between the tubs 12 when they are stacked together during shipping and storage. The gap allows the packs 12 to be separated easily with minimal damage to the tub 12. The perimeter wall 22 of the tub 12 may define an opening 30 that is dimensioned to receive a structure support to support a consumer product package in a substantially upright and vertical position (e.g., freestanding) on a support surface (such as on a product display or on a store shelf).

An inner and/or outer surface of the base 20 may also accommodate packaging graphics and labeling. The base 20 may have a generally flat rear outer surface 75 to facilitate stacking the consumer product packages on top of each or on a flat shelf. However, the rear outer surface 75 need not be flat because the tub 12 may be vertically supported by a stabilizing structure or suspended from a hook utilizing a hanging member 14. An outer flange member 76 may extend about the perimeter wall 22 of the tub 12. The outer flange member 76 may extend continuously around the perimeter wall 22 or may extend only along a portion of the perimeter wall 22. In certain embodiments, the outer flange member 76 may be generally parallel to the base 20 and provide an area for a cover to couple to. The outer flange member 76 may be laminated with the same or similar polymeric material (e.g., polyethylene terephthalate) as a cover for an improved seal (e.g., a required removal force greater than 10 Newtons). The outer flange member 76 may extend outward beyond the perimeter wall 22 by about 2 mm, 4 mm, or 6 mm to about 8 mm, 10 mm, or 12 mm.

The perimeter wall 22 may be generally transverse to the base 20. For example, the perimeter wall 22 may taper inwardly from the outer flange member 76 toward the base 20 at an angle greater than zero to about 3 degrees per side. However, it is understood a greater taper angle may be used if desired. The taper of the perimeter wall 22 may improve the manufacturability of the tub 12 (i.e., improved release of the tub 12 from a mold or tool). The perimeter wall 22 may define one or more openings 30 that are in communication with the cavity 74. In certain embodiments, the opening 30 may be located at a bottom portion (e.g., an end wall 80) of the tub 12 opposite the hanging member 14 and transverse to the base 20. The opening 30 may be dimensioned to receive a stabilizing structure. The opening 30 may be die cut or laser cut into the bottom portion 80 of the tub 12 (e.g., the end wall 82). Although only one opening 30 is shown, it is understood that the tub 12 may have a plurality of openings 30 each dimensioned receiving one or more stabilizing structures.

In certain embodiments, the tub 12 may have a hanging member 14 to facilitate the displaying (e.g., centering) the consumer product package on a hanging display. Hanging displays, such as peg boards offer increased versatility for presenting articles to consumers. For example, pegboard racks that revolve or spin work extremely well for stores that have limited floor space. The hanging member 14 may have an opening 16 extending therethrough that is dimensioned to receive a peg or hook of a peg board style display. The opening 16 may be circular, a slot, or any other geometry known to those skilled in the art for easy placement of the tub 12 on a peg or hook. The hanging member 14 may have other configurations, such as a hook, to facilitate the mounting of the consumer product package to a string or wire. The hanging member 14 may be integral with the tub 12 or may be a separate member that is joined (e.g., adhesives) to the tub 12. Although the opening 16 is shown extending through the hanging member 14, it is understood that the hanging member 14 is part of the tub 12 and the opening 16 may extend directly through the tub 12. In other embodiments, the consumer product package may not have a hanging member 14 (e.g., the consumer product package may be displayed on a store shelf and not on a peg board).

The consumer product package may have the advantage of not requiring any additional assembly by store clerks position the tub 12 in a substantially upright vertical position. For example, some self supporting packages, such as the package generally disclosed in U.S. Pat. No. 3,785,546, require the store clerk to unfold a support structure that has been fixed to a wall of the package. These types of packages rely on the store clerk to assemble (e.g., unfold) the support structure properly. The support structure may also become damaged during assembly or as the product is handled by prospective consumers. In addition, these types of support structures take up additional space on the store shelf and do not allow the packages to be self indexing. For example, typical support structures do not allow for consistent spacing because the front of one package may not directly contact the rear face of an adjacent package. Furthermore, a pressure applicator may contact and deform the folding support structure.

Figure 2:
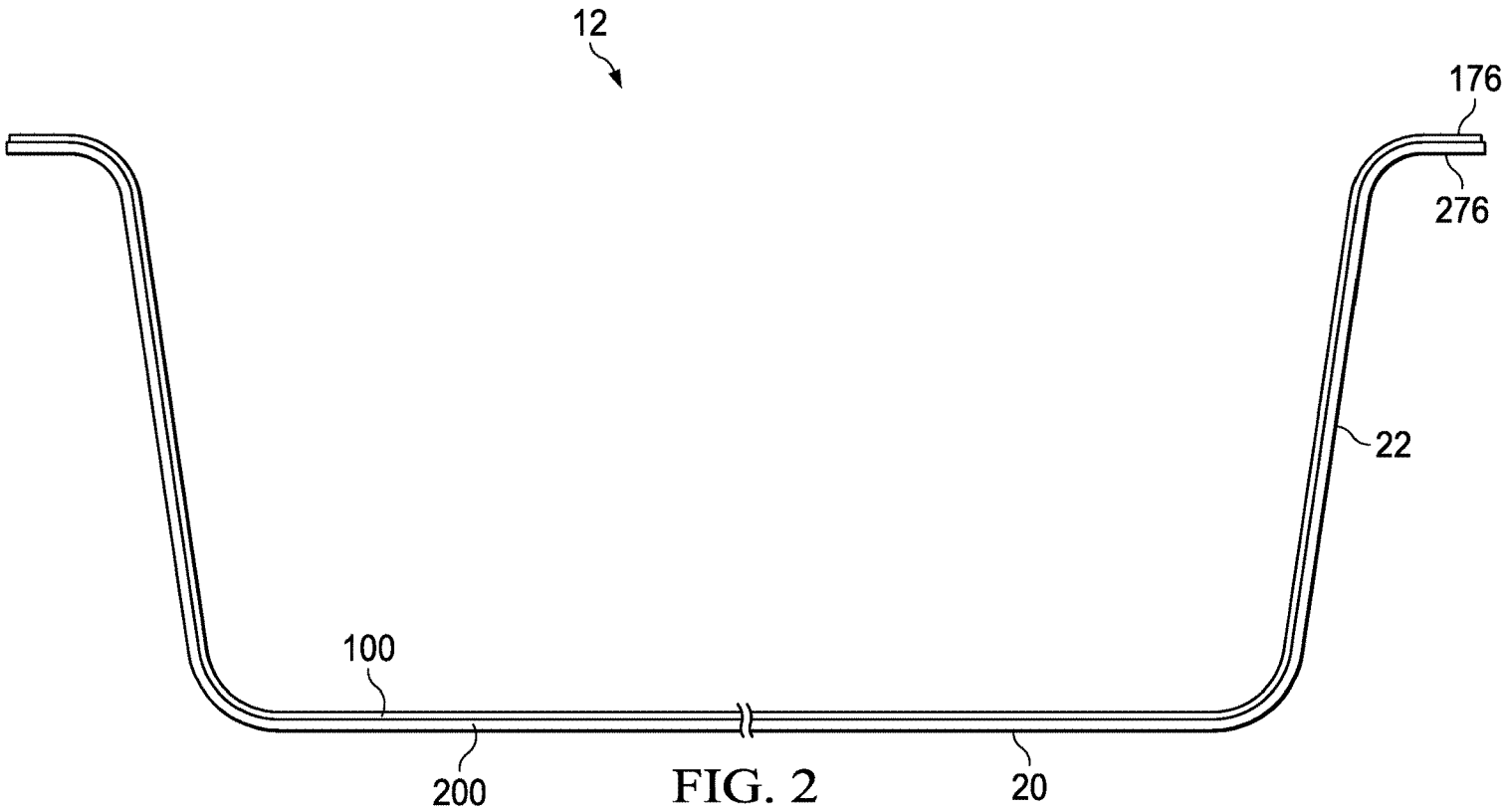
FIG. 2 is a cross sectional simplified view of the laminate substrate suitable for forming a tub taken along view line A-A of FIG. 1.
Figure 3:
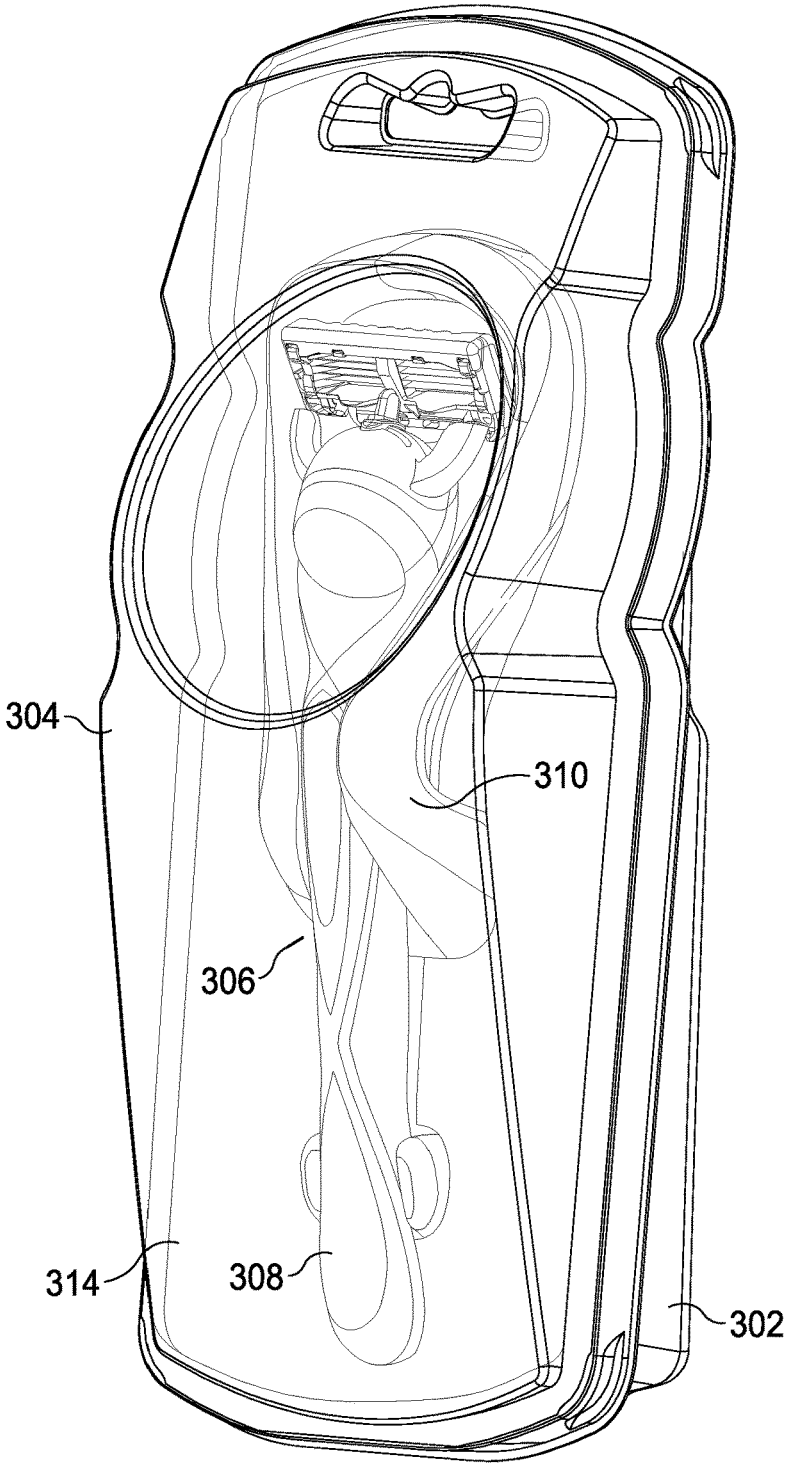
FIG. 3 is a perspective view of a consumer product package in accordance with an embodiment of an invention.
Figure 4A:
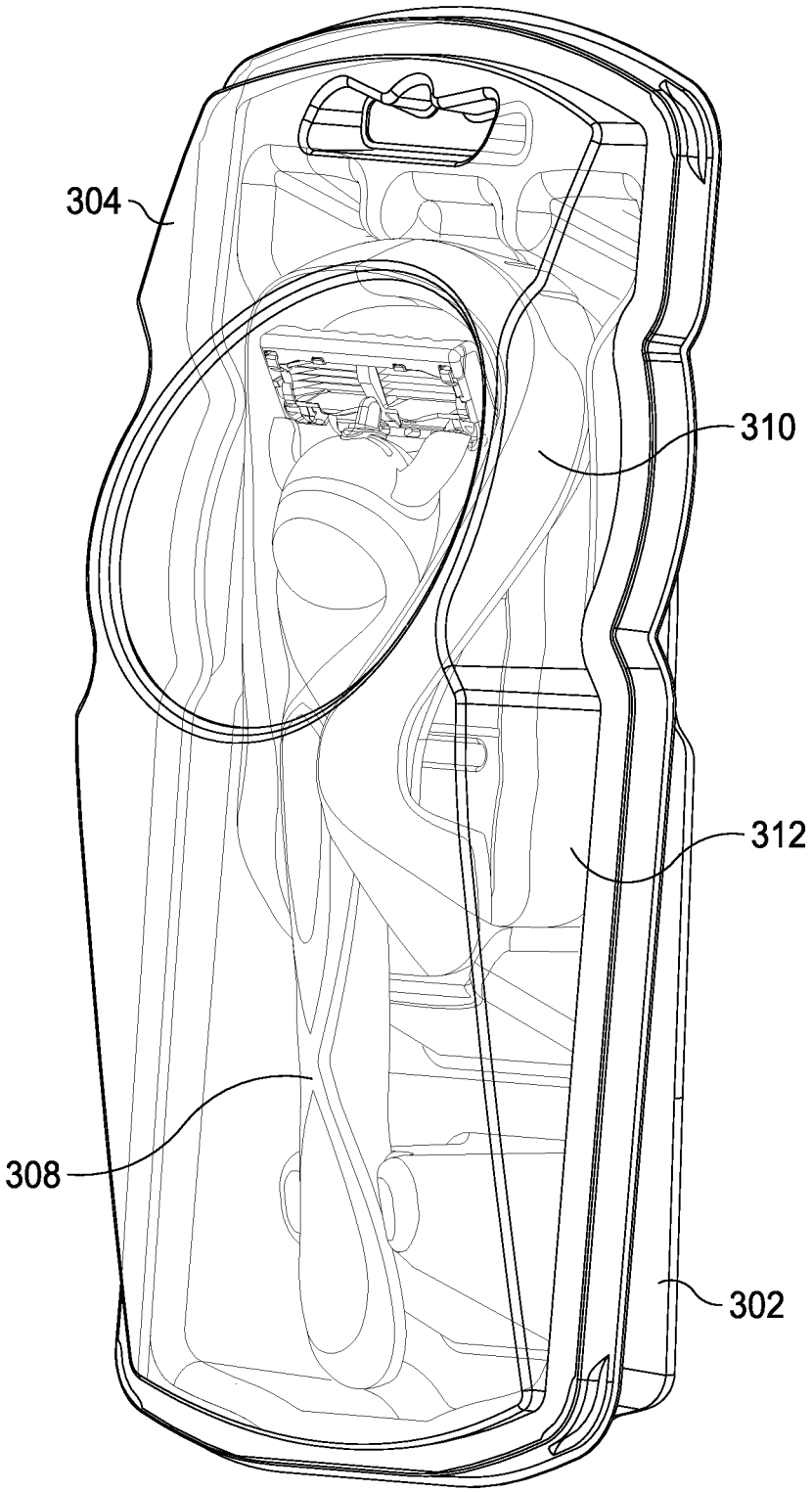
FIGS. 4A-4C are various perspective and exploded views of a consumer product package according to an embodiment of the invention.
Figure 4B:
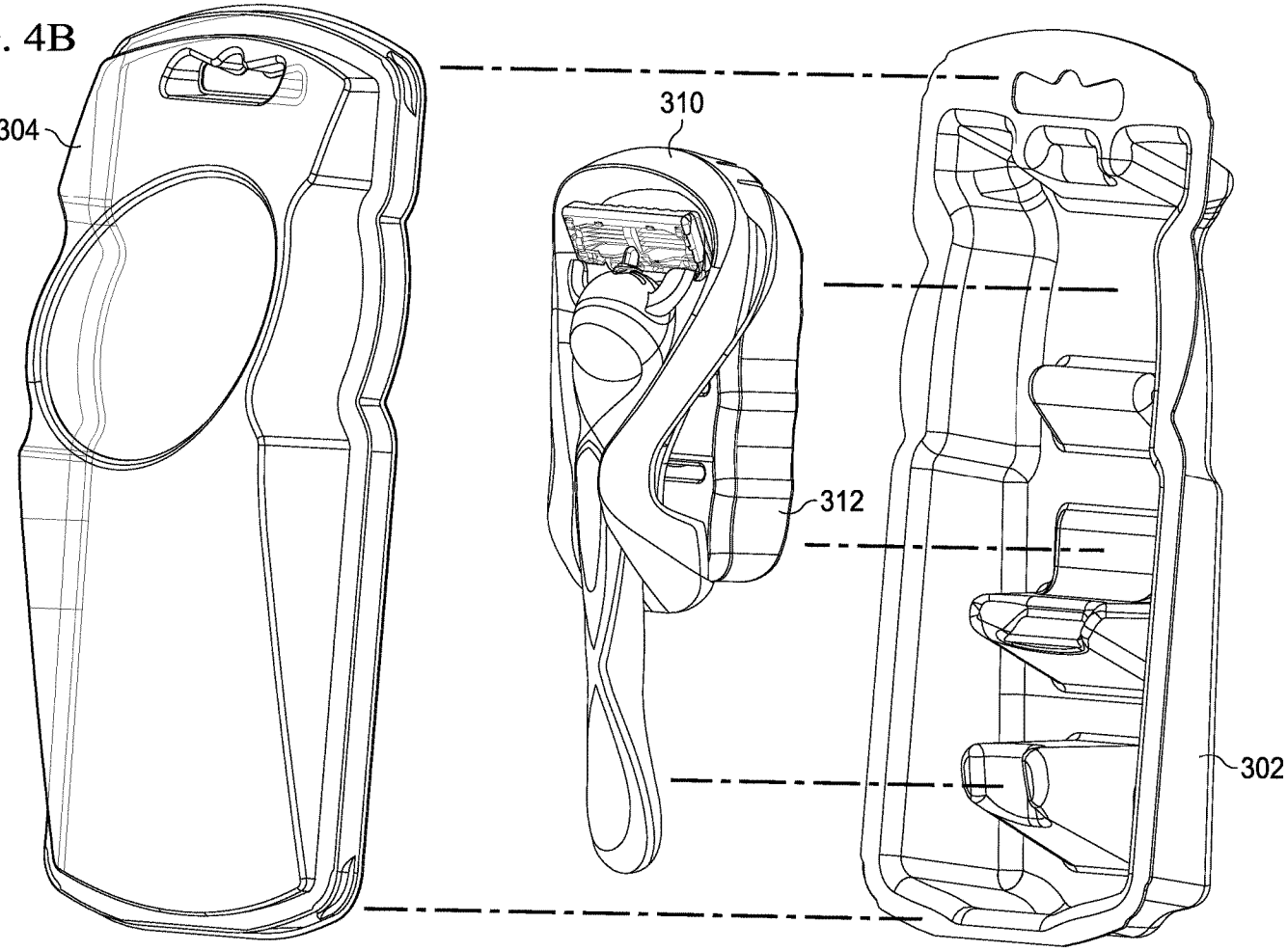
Figure 4C:
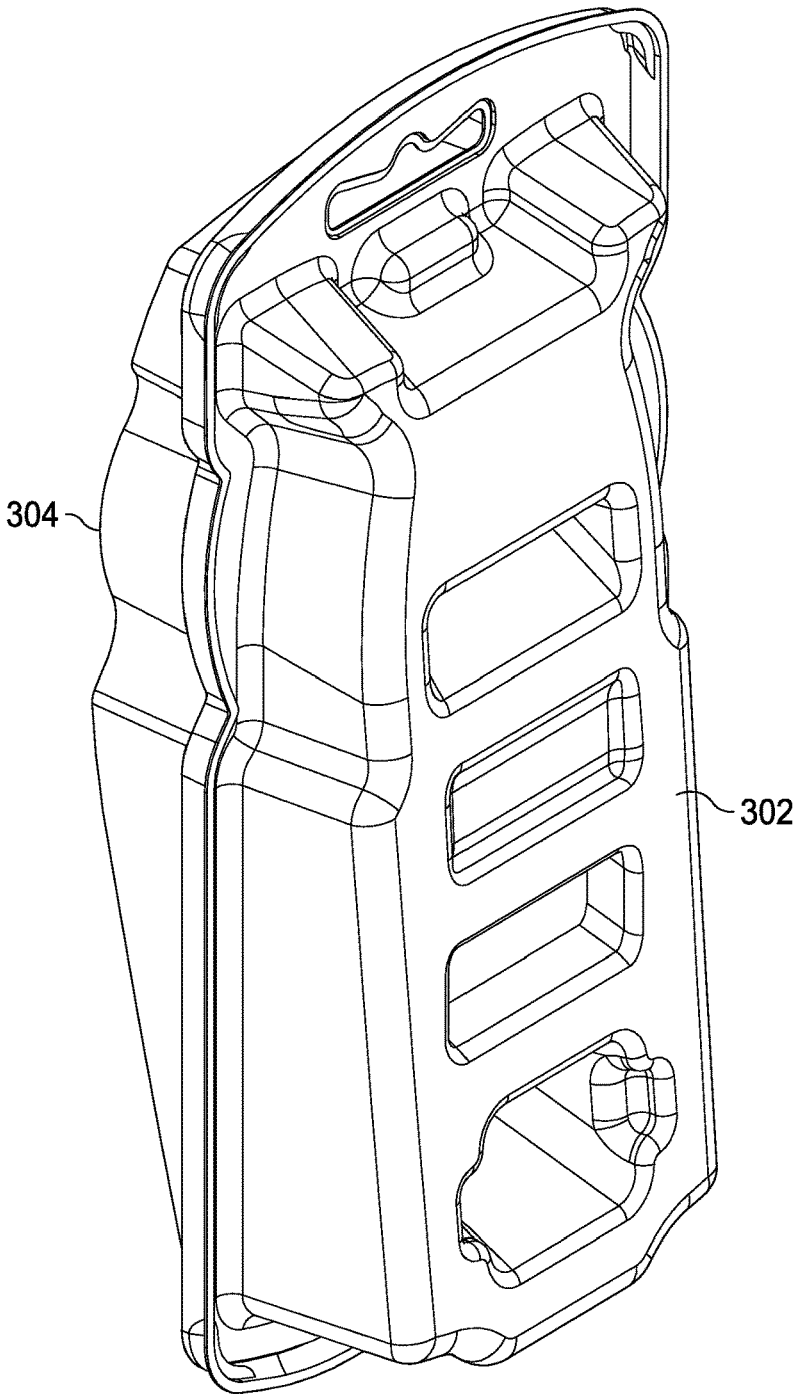

Referring now to FIG. 2, taken along view line A-A of FIG. 1, the tub 12 is shown comprising a laminate structure formed of cellulosic based substrate 200 and polymeric laminate 100. The laminate structure forms tub having a base 20 and perimeter wall 22. The tub also forms an outer flange formed by said laminate structure. The portions of the laminate structure forming the outer flange include outer flange cellulosic based substrate 276 and outer flange polymeric laminate 176. A cover may be removably attached to said outer flange polymeric laminate 176. As shown herein, the polymeric laminate layer is intermediate the cellulose based substrate and the cavity formed in the tub. In one embodiment, the tub forms an interior surface which defines the cavity. The interior surface can be at least partially coated with the polymeric laminate layer, preferably entirely coated. Without intending to be bound by theory, it is believed that adding the specific polymeric laminate layer to the cellulosic based substrate of the present invention allows the structure to be desirably strong and resilient to collapse upon applied pressure. Further, it is believed that the present laminate structure can provide sufficiently air tight and/or water tight seal to protect the contents stored within. In one embodiment, the cavity can be hermetically sealed. Moreover, it is importantly believed that by selecting a cellulosic based substrate being somewhat porous with sufficiently large interstitial spaces formed by the fibers, amounts of the polymeric laminate can fill the voids formed in the cellulosic based substrate thereby enhancing the adhesion between the two layers and additionally strengthening the laminate compared to similar non-laminated structures or those using cellulose pulps which form more closed cell surfaces. In an alternative embodiment to a laminate structure, the two layers may be adhered to one another via UV adhesive, cold glue, hot melt, etc.

One embodiment of the present invention relates to a method of forming a laminate substrate comprising the steps of: forming a pulp mixture comprising: a bamboo derived pulp feed; a sugar cane derived pulp feed; a bulrush derived pulp feed; and a soda ash feed; molding said pulp mixture into a cellulosic substrate with an optional colorant additive; and laminating at least a portion of said cellulosic substrate with a polymeric laminate layer. Each of the feeds can include the cellulose based material at varying concentrations as they are commercially available as a raw material, such as for example bagasse at 0.3% to 0.4% by weight with water. The soda ash can be added at a rate of 7% to 8% by weight in water. Depending on the amounts of each pulp desired, the relative feed rates can be varied. The molding step can be by thermoforming said pulp mixture. In one embodiment, said step of forming said pulp mixture is performed at an elevated temperature from about 35 C to about 60 C, or from about 50 C to about 55 C. In another embodiment, said step of molding comprises thermoform molding said pulp mixture at a temperature of from about 180 C to about 220 C, or about 200 C and a pressure of from about 28 tons to about 32 tons, or about 30 tons.

The laminate structure of the present invention comprises: a cellulose based substrate and a polymeric laminate. The cellulosic based substrate comprises a blend of grass based pulp materials such as, bamboo derived pulp, sugar cane derived pulp (commonly referred to as bagasse pulp), bulrush derived pulp, and mixture thereof. In one embodiment, the cellulosic based substrate comprises from about 50% to about 75%, or from about 60% to about 70%, or about 65% of a bamboo derived pulp; from about 15% to about 35%, or from about 20% to about 30%, or about 25% of a sugar cane derived pulp; and up to about 25%, or from about 5% to about 15%, or about 10% of a bulrush derived pulp. Other pulps may also be included as needed (e.g., wheat stalk, rice hull, etc, and combinations thereof available from BeGreen Packaging LLC, Santa Barbara, Calif.). Without intending to be bound by theory, it is believed that this blend of grass based pulps provides desirable container strength and flexibility. For example, if insufficient amounts of bamboo derived pulps are used, the container may not be sufficiently rigid. If too much is used, the container may not be sufficiently flexible.

The polymeric laminate layer at least partially coats said cellulosic base substrate, said polymeric laminate layer has a thickness of from about 0.02 mm to about 0.1 mm, or from about 0.025 mm to about 0.05 mm, or from about 0.035 mm to about 0.04 mm, or about 0.038 mm. In one embodiment, polymeric laminate layer has an average thickness of from about 0.02 mm to about 0.1 mm. The polymeric laminate layer can be made from a clear polymer material, including, but not limited to polyvinyl chloride (PVC), polyethylene terephthalate (PET), high density polyethylene (HDPE), and low density polyethylene (LDPE), polypropylene (PP), or any combination thereof. In one embodiment, the laminate is made of PET. Without intending to be bound by theory, it is believed that although thicker laminate layers can be applied, the thickness of the polymeric laminate layer of the present invention importantly provides sufficient air and/or water resistance and load strength while not being overly rigid that the laminate will peel off the cellulosic based substrate when the package is deformed during handling or manufacture. Further by providing a sufficiently thin laminate thickness, the polymeric material can breakdown in similar time with the cellulose based substrate. By water resistant or water proof, it is meant that water will not readily enter and pass through the laminate structure during normal handling and usage conditions. Those of skill in the art will understand that given sufficient time and pressure of deformation or structural damage to the laminate substrate, water and air will eventually be able to enter and likely pass through. By water resistant or water proof, it is meant that certain embodiments of the present invention can withstand water entry following making and before the package is opened by the user, during the normal course of shipping, handling and stocking.

In certain embodiments, the tub may be formed from a cellulosic material such as paperboard and/or renewable materials as described above. The tub may be the natural color of the paperboard and/or renewable material or may alternatively contain a dye (e.g., orange or blue) for enhanced consumer appeal. The cover may be transparent and/or translucent such that a consumer can see the articles disposed within the tub. In certain embodiments, the cover may be injection molded or thermoformed from a clear polymer material, including, but not limited to polyvinyl chloride (PVC), polyethylene terephthalate (PET), high density polyethylene (HDPE), and low density polyethylene (LDPE), polypropylene (PP), or any combination thereof. Alternatively, the cover may include a flat or formed paperboard or polymeric material with a heat sealable coating and/or an anti-theft coating. The cover may also include thin polymeric films that are sealed to the tub. The tub may comprise similar of different materials as the cover 18. In one embodiment, the package may be formed to include a tear away tab by including a cut out in the outer flange so the cover is exposed and can be easily pulled away from the tub. Other suitable methods to provide a tear away tab can include purposefully not sealing a discrete region of the cover and outer flange. These and other easy opening mechanisms are known and suitable for use herein.

Shown in FIGS. 3, 4A, 4B, and 4C are embodiments of an assembled consumer product package. The consumer product package may be mounted to a hanging display (e.g., a peg board) and/or displayed on a store shelf. It is understood that the consumer product package may include any type of blister packs, including, but not limited to card blisters and clamshells. The consumer product package includes a tub 302 for holding and displaying one or more consumer products and a cover 304 affixed to the tub 302. In the embodiment shown in FIGS. 3, 4A, 4B, and 4C, the cover 304 is a blister. The tub 302 is coupled to a blister 304, and the tub 302 and the cover 304 define a cavity to receive a consumer product 306. The consumer product 306 may include one or more items, for example, the consumer product 306 may include a shaving razor 308, a shaving tray 310, a cartridge organizer 312, and, optionally, a display card 314. At least a portion of the shaving razor 308 may releaseably engage the shaving tray 310 and/or the shaving tray 310 may releasably engage the cartridge organizer 312. The cartridge organizer 312 may hold and/or display one or more shaving cartridges. The optional display card 314 may be positioned between the shaving tray 310 and the cartridge organizer 312 or, alternatively, the display card 314 may be placed over or dropped over the consumer product 306. The display card 314 may have various graphic design elements and relevant information about the consumer product.

In an embodiment in which the consumer product package stands on a shelf, a portion of the bottom surface of the cover 304 can be flat, to assist the consumer product package in standing. Additionally or alternatively, a bottom surface of the tub 302 may only partially contact a surface when the consumer product package is intended to stand on a shelf so as to additionally assist the consumer product package in standing. At least a portion of the bottom surface of the tub 302 is flat.

In an embodiment, the tub 302 may have portions configured to engage the consumer product. For example, a projection from the base of the tub may include a recess to receive a handle of a shaving razor 308. Additionally or alternatively, another projection from the base of the tub may be configured to engage the cartridge organizer 312 and/or the shaving tray 310. Such projections from the base of the tub extend into the cavity of the tub. Recessed portions of a perimeter wall (in that the portions are recessed compared to a top surface of the tub) may optionally contact the cartridge organizer 312 and/or the shaving tray 310 when the consumer product package is assembled. When the consumer product package is assembled, the tub 302 and the cover 304 are intended to secure the consumer product so as to avoid jostling or damage to the consumer product. In an embodiment, the tub 302 is integrally formed with the materials described herein. Additionally or alternatively, the projections within the tub extending into the cavity may be seen as recesses when the tub is viewed from the outside, with the cavity turned away from a viewer.

Figure 5:
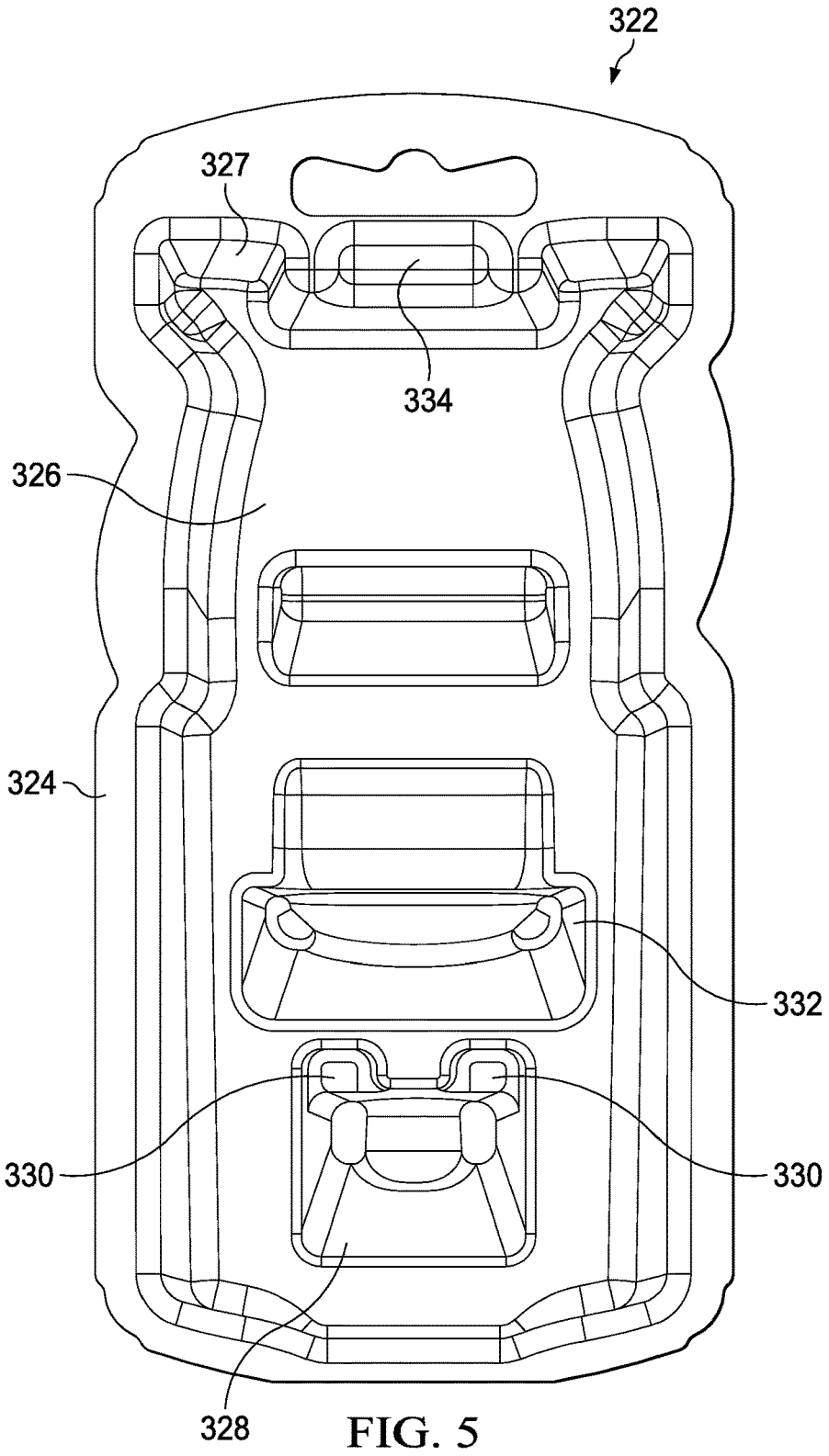
FIG. 5 is a top view of a tub in accordance with an embodiment of the invention.

Referring now to FIGS. 5-12B, shown are various embodiments of a tub. Shown in FIG. 5 is a tub 322 with top surface 324, a base 326, and a perimeter wall 327 defining a cavity. The base 326 includes a plurality of projections. In an embodiment, a first projection 328 may include a recessed portion to receive a portion of a consumer product. The first projection 328 may, optionally, include at least one secondary projection 330 in which a height of the top surface of the at least one secondary projection 330 is lower than a height of a top surface of the first projection 328. The height of the top surface of the at least one secondary projection 330 may, optionally, be about 15%-30% of the height of the top surface 324, preferably about 20% to about 25%. In an embodiment, there may be no at least one secondary projection 330 or there may be more secondary projections 330 than shown. Additionally or alternatively, the base 326 includes a second projection 332. The second projection 332 may include a recessed portion and/or tips to engage a consumer product. The perimeter wall 327 may include portions extending into the cavity. Such portion may include at least one recessed portion 334 in which a height of the recessed portion is lower than a height of the top surface 324. The height of the recessed portion may, optionally, be about 15%-30% of the height of the top surface 324, preferably about 20% to about 25%. In an embodiment, there may be no at least one recessed portion 334 or there may be more recessed portions 334 than shown. In an embodiment, a tub 322 can include one or more secondary projections 332 and/or one or more recessed portions 334 of the perimeter wall 327.

Figure 6:
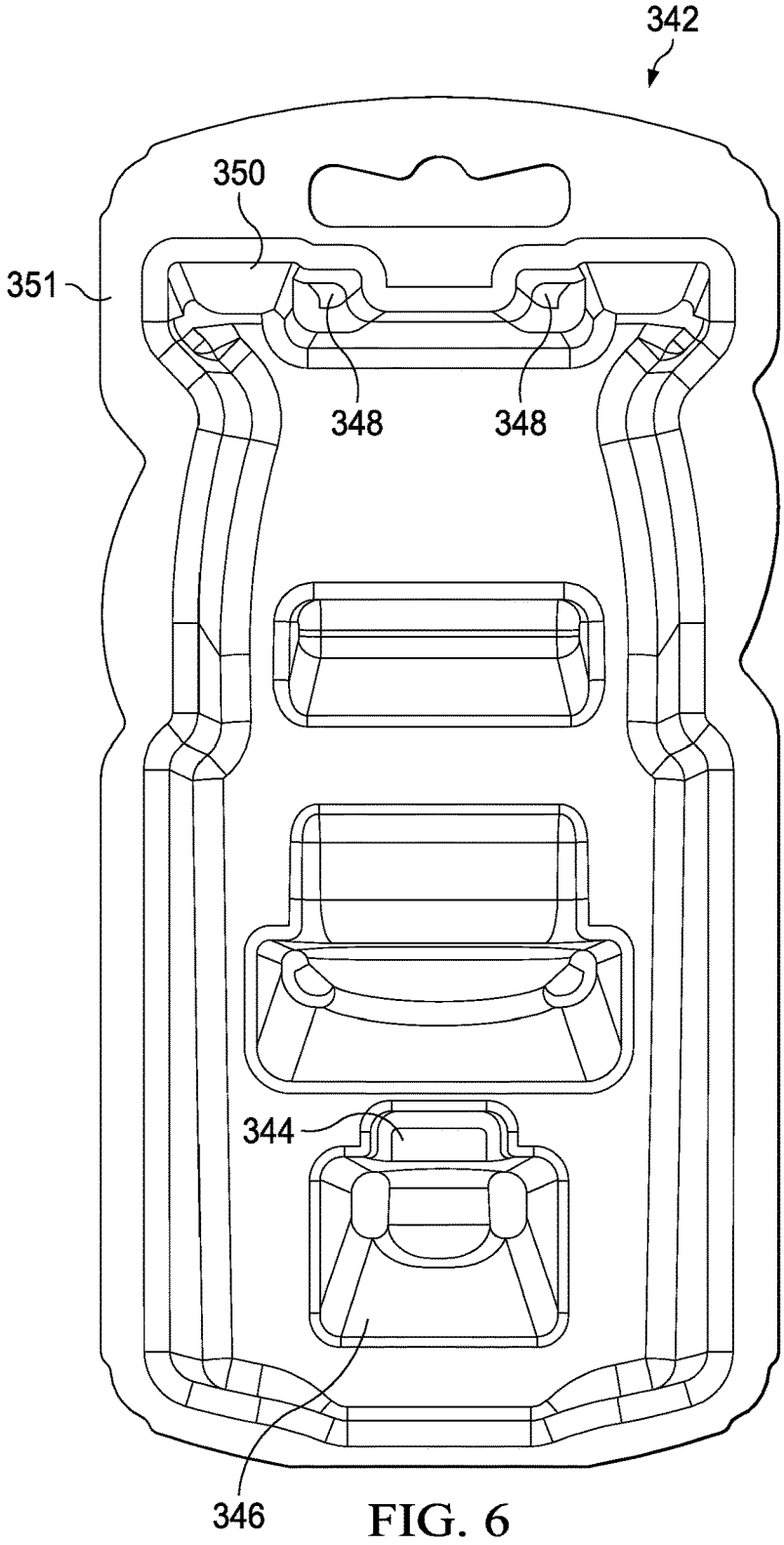
FIG. 6 is a top view of a tub according to an embodiment of the invention.

In an embodiment, shown in FIG. 6 is a tub 342 with one secondary projection 344 having top surface with a height lower than a top surface of a first projection 346. Also shown are two recessed portions 348 of a perimeter wall 350 in which the recessed portions have a height lower than a top surface 352 of the tub 342. The height of the top surface of the one secondary projection 344 and/or the height of the top surface of the two recessed portions 348 may, optionally, be about 15%-30% of the height of the top surface 352, preferably about 20% to about 25%. In an embodiment, the tub 342 may have fewer (such as none) or more secondary projections 344 and/or recessed portions 348 than shown. In an embodiment, the perimeter wall 350 is non-linear such that the perimeter wall 350 has indentations and/or portions extending into the cavity. Additionally or alternatively, each side wall of the perimeter wall 350 is non-linear.

Figure 7:
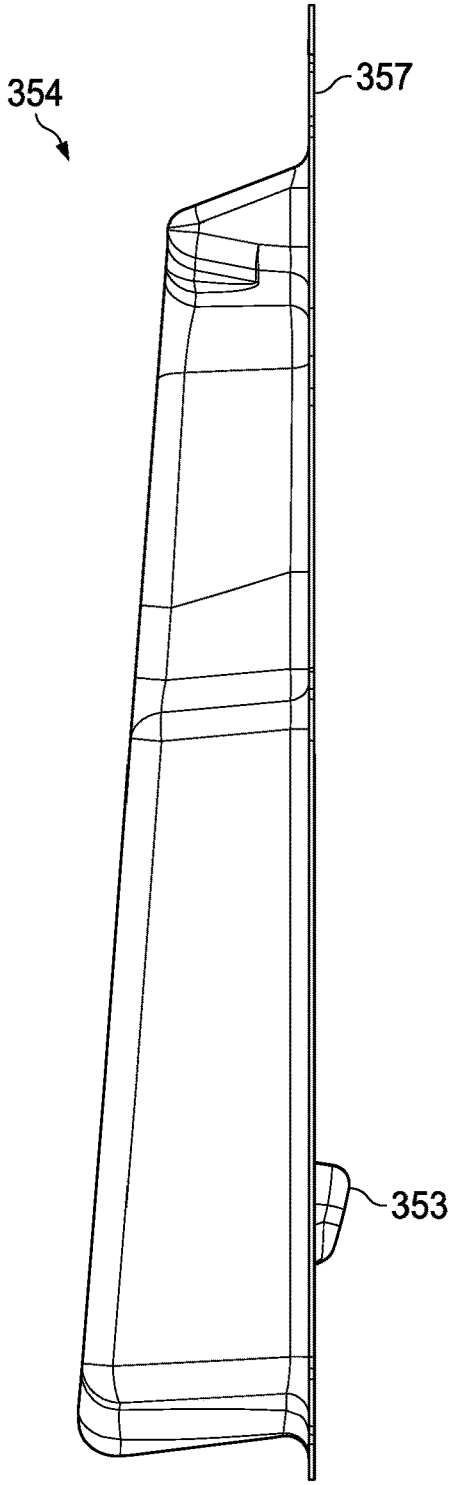
FIG. 7 is a side view of the tub of FIG. 6.

In an embodiment, shown in FIG. 7, a first projection 352 from a base of a tub 354 has a height taller than a top surface 356 of the tub 354 such that the first projection 352 extends out of the tub 354.

Figure 8A:
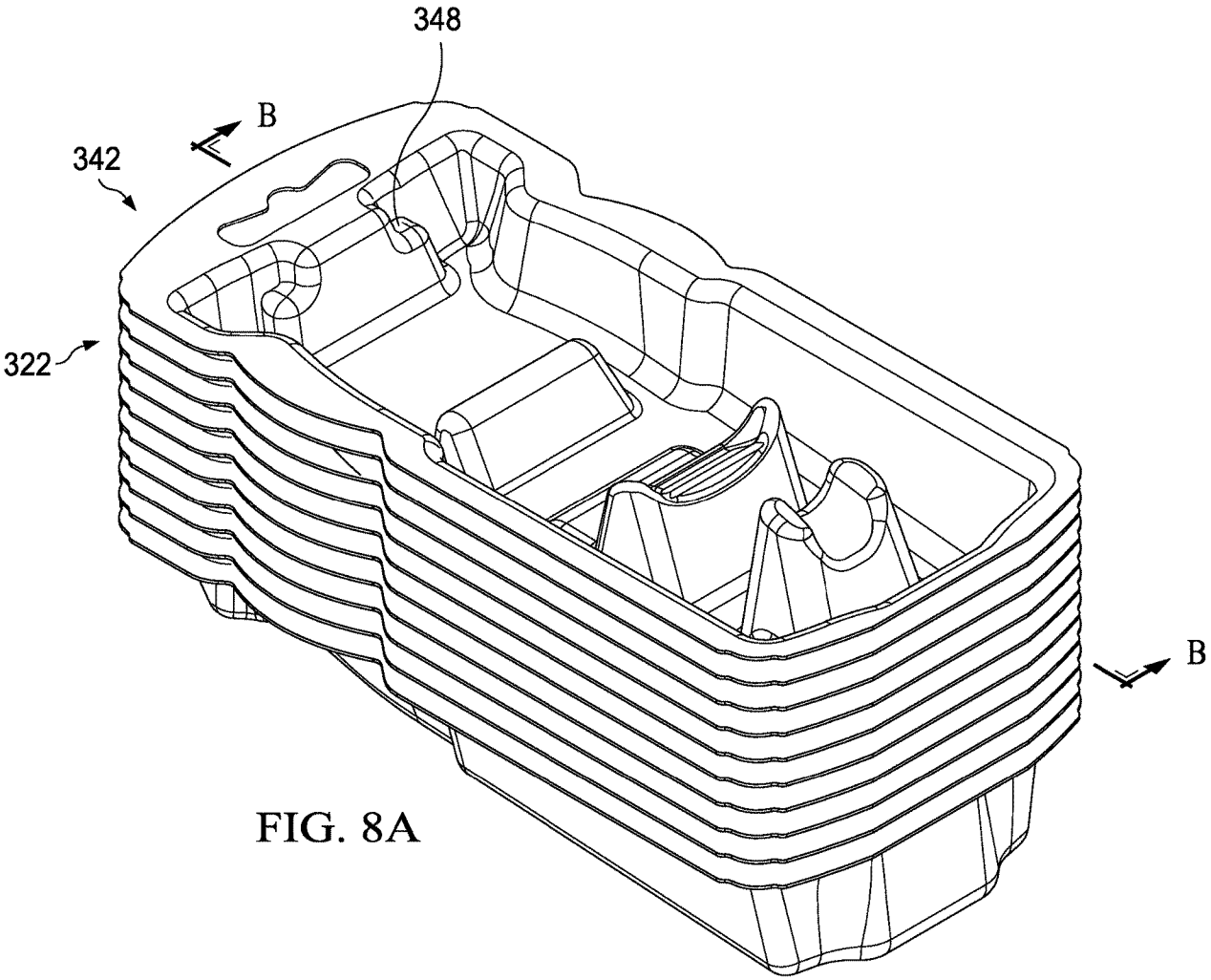
FIG. 8A is a perspective view of a stack of the tubs of FIGS. 5 and 6.
Figure 8B:
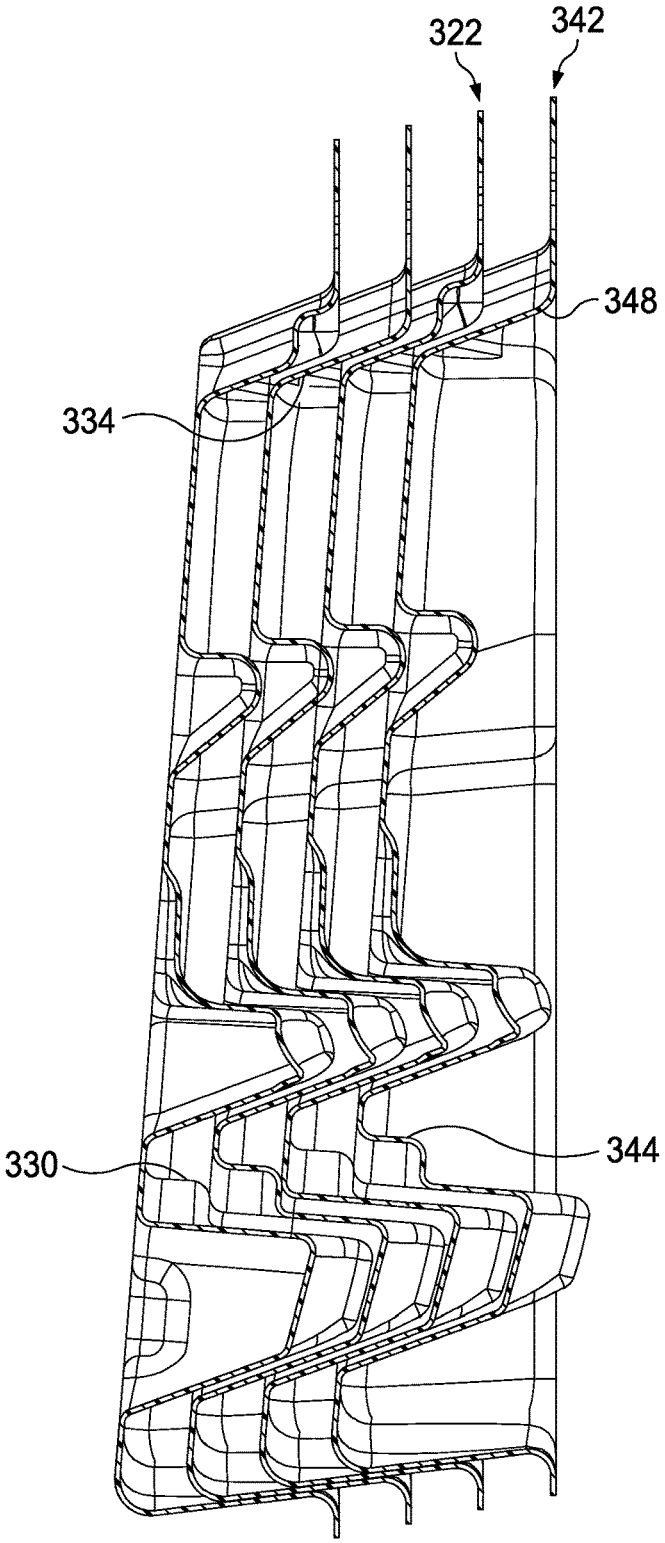
FIG. 8B is a cross sectional view of the stack of tubs taken along view line B-B of FIG. 8A.

Referring to FIGS. 8A and 8B, the tubs can be stacked and unstacked for processing. The secondary projections 332 and/or recessed portions 334 of the tub 322 shown in FIG. 5 and the secondary projections 344 and/or recessed portions 348 of the tub 342 shown in FIG. 6 can assist in stacking and unstacking tubs. Without intending to be bound by any theory, it is believed that such features may assist with denesting such stacked structures as without such denesting features the surface energy of such tubs made from the materials described herein (e.g., fiber tubs) is sufficient or high enough to cause the tubs to stick together during stacking and unstacking. Similarly, without intending to be bound by any theory, it is believed that fiber tubs without adequate denesting features add complexities and cost to manufacturing and/or processing as manual intervention is necessary for processing. This is believed to be true as a tub as described herein has many draft angles, positive and/or reverse/negative draft angles, thus making adequate denesting features an important consideration. It is believed that the denesting features of the present invention may facilitate automated processing as automation will be able to process the tubs, such as stacking and unstacking the tubs. Automated processing may reduce cost and make use of environmentally friendly fiber trays more attractive for use. Such fiber trays will feed from machine pick and place magazines, as it is known in the art, with vacuum and suction devices making processing and assembling more efficient. Additionally or alternatively, utilizing manual feed of such fiber trays may also separate easier for material handlers, thus, speeding up the manual feed operation and making it more efficient. In an embodiment shown in FIG. 8B, the tub 322 shown in FIG. 5 can be stacked and/or unstacked with the tub 342 shown in FIG. 6. Additionally, other tubs with denesting features can be stacked or unstacked. Preferably, the denesting features of one tub are not in the same location as the denesting features of another tub on top or on bottom of another tub. It is believed that when the tubs are stacked, the secondary projections 332, 344 and/or recessed portions 334, 348 assist with denesting as portions of these features are not in contact with the tub stacked above and/or below. Such portions free of contact may help mitigate the surface energy of fiber tubs to facilitate easier processing. In an embodiment, when tubs 322, 342 are stacked, a portion (e.g., a vertical surface and/or a horizontal surface; and/or a portion of a vertical surface and/or a portion of a horizontal surface) of the denesting features are free of contact from any portion of a tub stacked above or below. In an embodiment, when stacked, a vertical portion closer to the hanging member of the second projection 332 of tub 322 is spaced apart from a vertical portion closer to the hanging member of a similarly shaped projection of tub 342, optionally, spaced about 0.2 mm to about 2.5 mm, preferably about 0.5 mm to about 2 mm. Without intending to be bound by any theory, it is believed that one or both of the denesting features and/or the spaced apart portions of projections of tubs facilitate easier manufacturing, assembling, and/or processing of tubs.

Figure 9A:
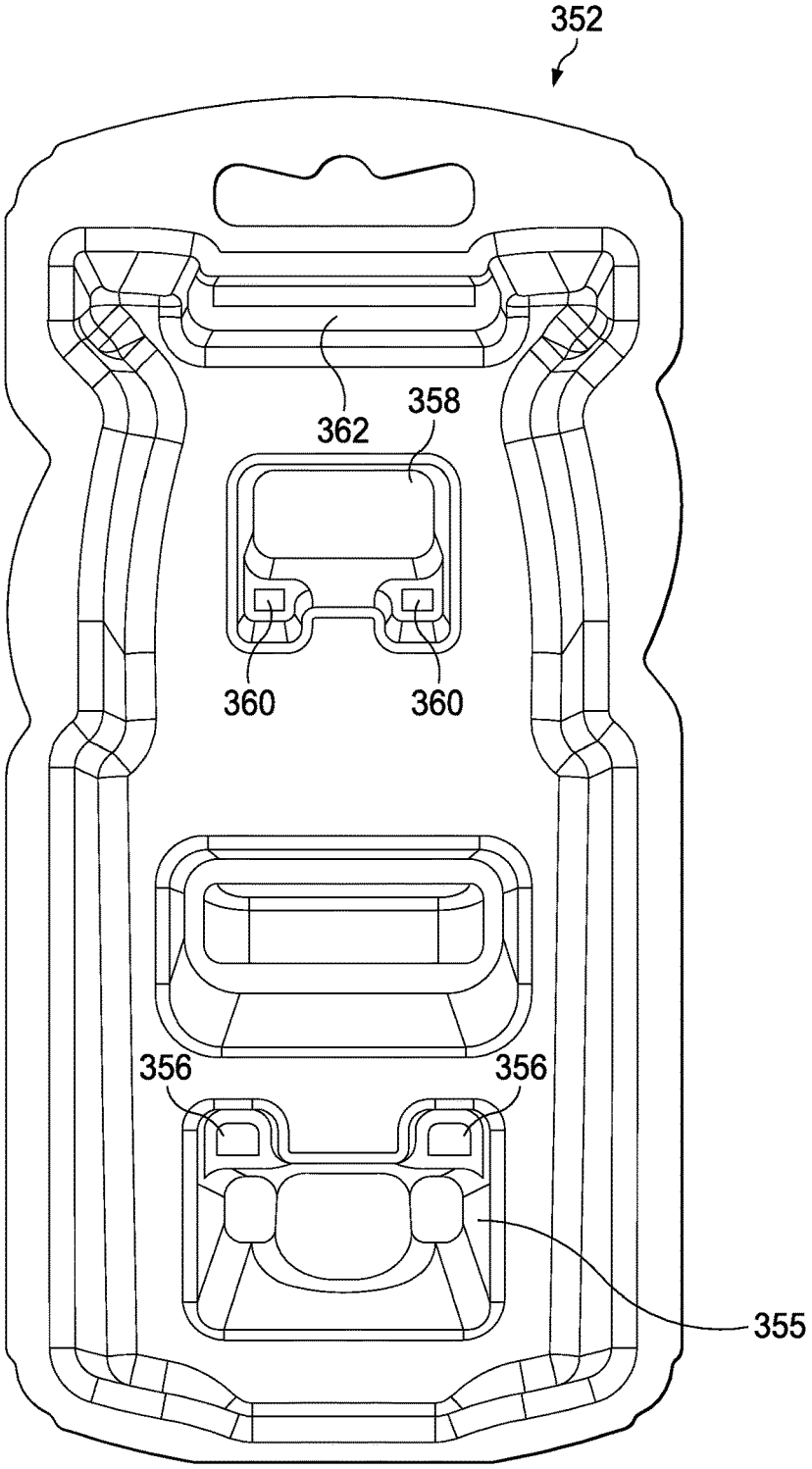
FIGS. 9A and 9B are top and perspective views of a tub in accordance with an embodiment of the invention.
Figure 9B:
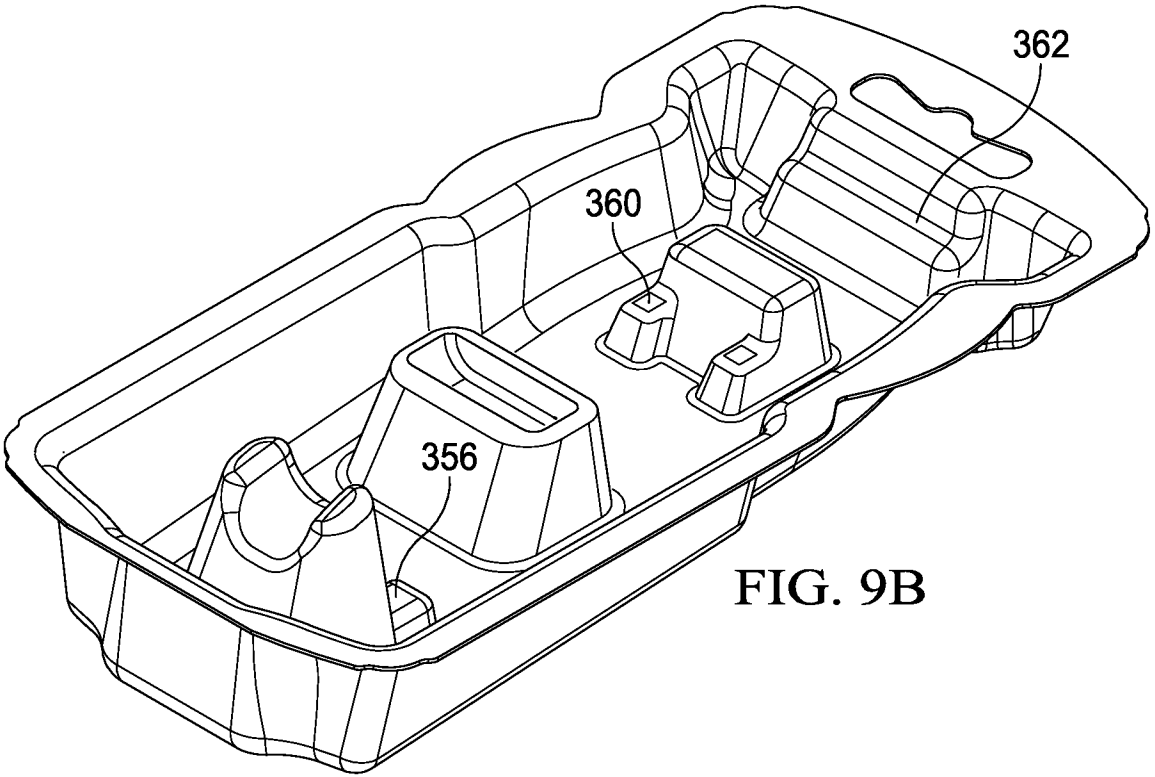

Shown in FIGS. 9A-12B are other various embodiments of tubs. Referring to FIGS. 9A and 9B, a tub 352 has a first projection 354. The first projection 354 includes a recessed portion configured to receive a consumer product. The first projection 354 may optionally also include secondary projections 356 in which a height of the secondary projections 356 is lower than a height of the top surface of the first projection. Additionally or alternatively, the height of the secondary projections 356 is lower than a height of the lowest surface of the recessed portion. In an embodiment, the tub 352 can have fewer or more secondary projections, disposed around various portions of the first projection 354, than as shown. The tub 352 may also have a second projection 358 configured to engage with a consumer product. The second projection 358 includes additional secondary projections 360. A height of the additional secondary projections 360 can be lower than a height of a top surface of the second projection 358. In an embodiment, the tub 352 can have fewer or more additional secondary projections 360, disposed around various portions of the second projection 358, than shown. Additionally or alternatively, a perimeter wall of the tub 352 can include a recessed portion 362 in which a height of the recessed portion 362 is lower than a top surface of the tub 352. The recessed portion 362 can be elongate and may, optionally, be as long as the first projection 354, the second projection 358, and/or any other projection extending from a base of the tub 352. The height of the top surface of the secondary projections 356 of the first projection 354, the height of the top surface of the additional secondary projections 360, and/or the height of the recessed portion 362 may, optionally, be about 15%-30% of the height of the top surface of the tub 352, preferably about 20% to about 25%.

Figure 10:
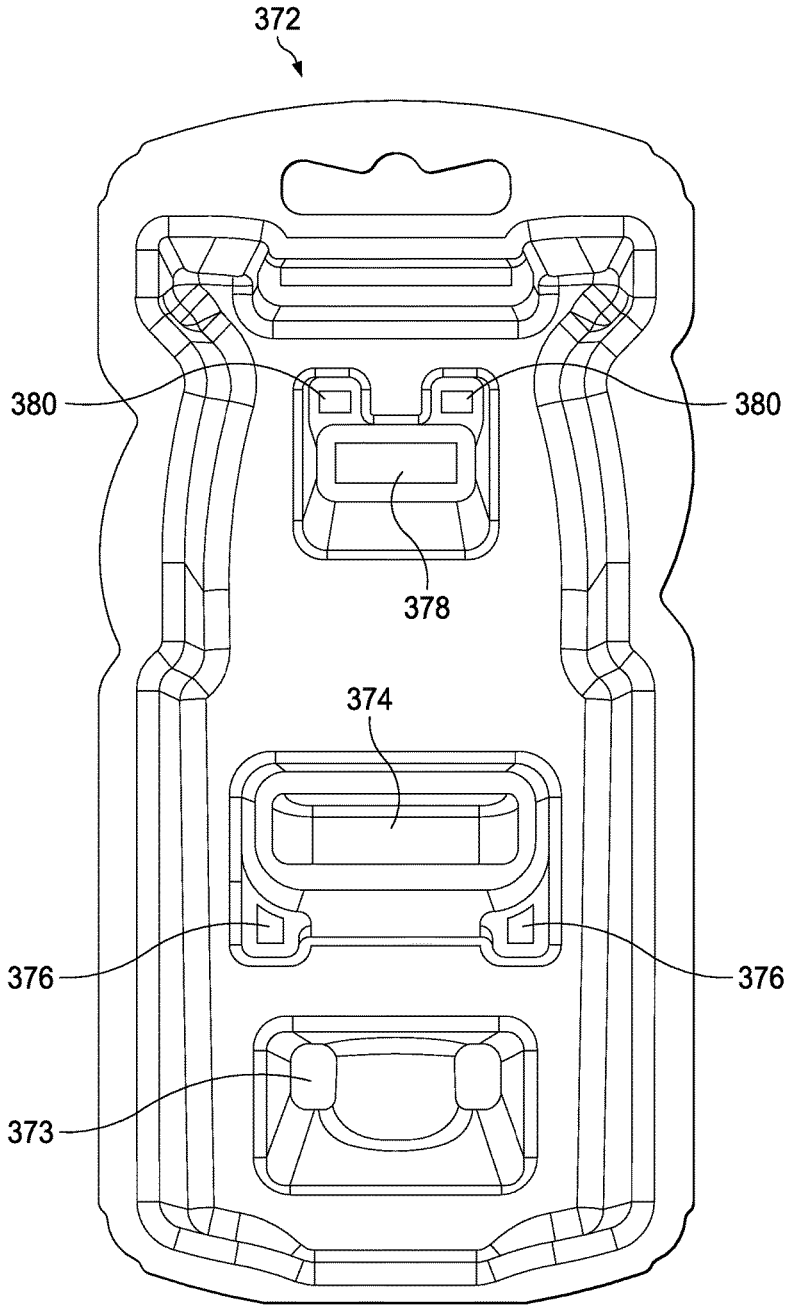
FIG. 10 is a top view of a tub according to an embodiment of the invention.

In an embodiment, e.g., that shown in FIG. 10, a tub 372 has a first projection 373 includes a recess to receive a consumer product, e.g., a handle of a shaving razor. The first projection 373 may optionally not include any secondary projections. The tub 372 has a second projection 374 configured to engage the consumer product, e.g., a cartridge organizer. The second projection 374 includes secondary projections 376 in which a height of the secondary projections is lower than a height of the second projection 374. In an embodiment, the second projection 374 can have fewer or more secondary projections 376, disposed around various portions of the second projection 374, than shown. The tub 372 also includes a third projection 378 configured to engage a consumer product, e.g., a cartridge organizer and/or shaving razor. The third projection 378 includes additional secondary projections 380 in which a height of the additional secondary projections 380 is lower than a height of the third projection 378. Additionally or alternatively, the tub 372 can include a perimeter wall having a recessed portion in which a height of the recessed portion is lower than a top surface of the tub 372. The height of the top surface of the secondary projections 376 of the second projection 374, the height of the top surface of the additional secondary projections 380, and/or the height of the recessed portion of the perimeter wall may, optionally, be about 15%-30% of the height of the top surface of the tub 372, preferably about 20% to about 25%.

Figure 11:
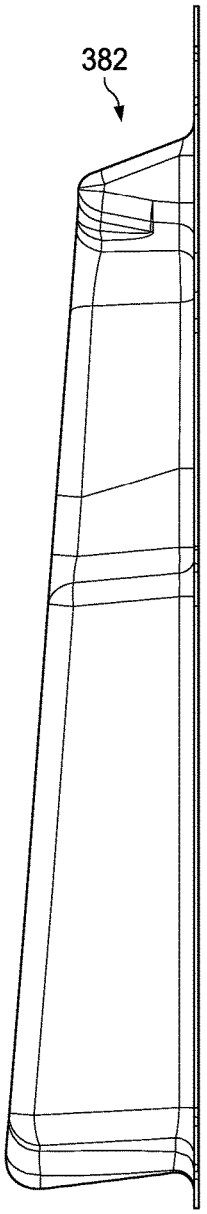
FIG. 11 is a side view of the tub of FIG. 10.

In an embodiment shown in FIG. 11, a tub 382 has a first projection (not shown) in which the first projection includes a recessed portion to receive a consumer product, e.g., a handle of a shaving razor. The first projection does not extend out of the tub 382 such that a height of the first projection is lower than a top surface of the tub 382.

Figure 12A:
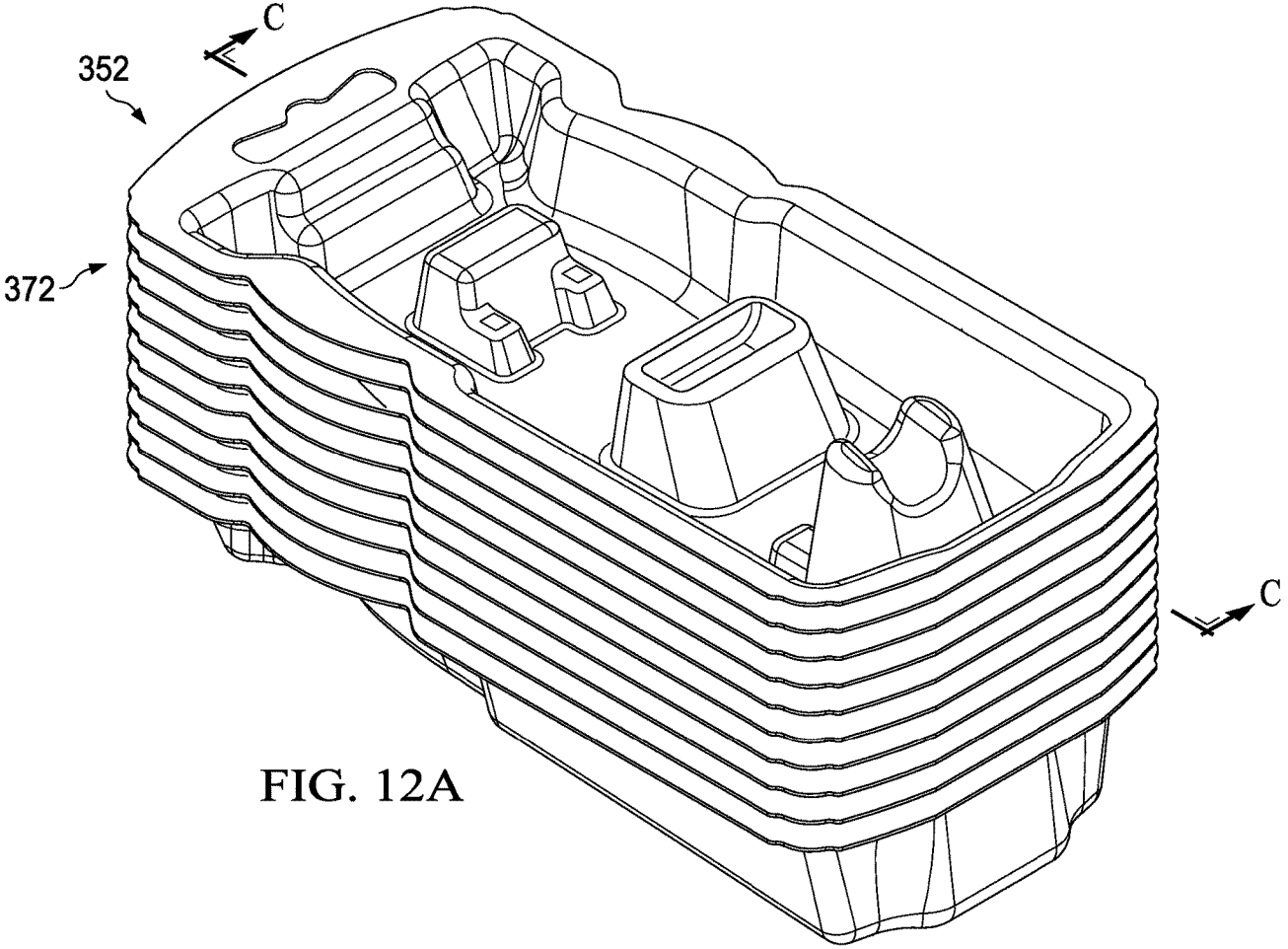
FIG. 12A is a perspective view of a stack of the tubs of FIGS. 9A, 9B, and 10.
Figure 12B:
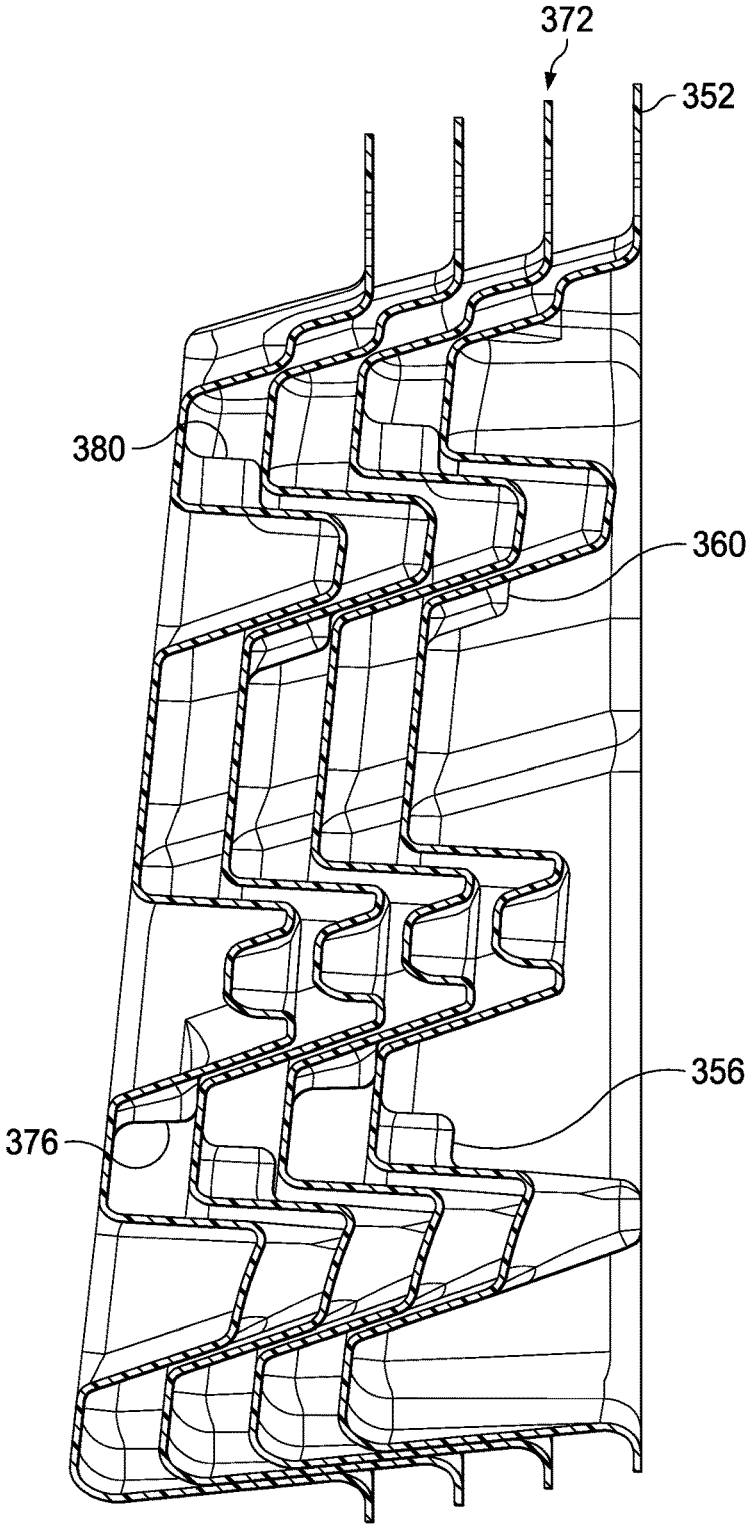
FIG. 12B is a cross sectional view of the stack of tubs taken along view line C-C of FIG. 12A.

In an embodiment, tubs 352, 372, 382 can be stacked and unstacked for processing. The denesting features of the tubs 352, 372, 382 can facilitate automated processing. Shown in FIGS. 12A and 12B is a stack of tubs 352, 372. Additionally, other tubs with denesting features can be stacked or unstacked. It is believed that when the tubs are stacked, the secondary projections 356, 360, 376, 380 and/or recessed portions 362 assist with denesting as portions of these features are not in contact with the tub stacked above and/or below. Such portions free of contact may help mitigate the surface energy of fiber tubs to facilitate easier processing. In an embodiment, when tubs 352, 372 are stacked, a portion (e.g., a vertical surface and/or a horizontal surface; and/or a portion of a vertical surface and/or a portion of a horizontal surface) of the denesting features are free of contact from any portion of a tub stacked above or below. In an embodiment, when stacked, a vertical portion closer to the hanging member of the first projection 354 of tub 352 is spaced apart from a vertical portion closer to the hanging member of the first projection 373 of tub 372, optionally, spaced about 0.2 mm to about 2.5 mm, preferably about 0.5 mm to about 2 mm. Without intending to be bound by any theory, it is believed that one or both of the denesting features and/or the spaced apart portions of projections of tubs facilitate easier manufacturing, assembling, and/or processing of tubs.

Figure 13A:
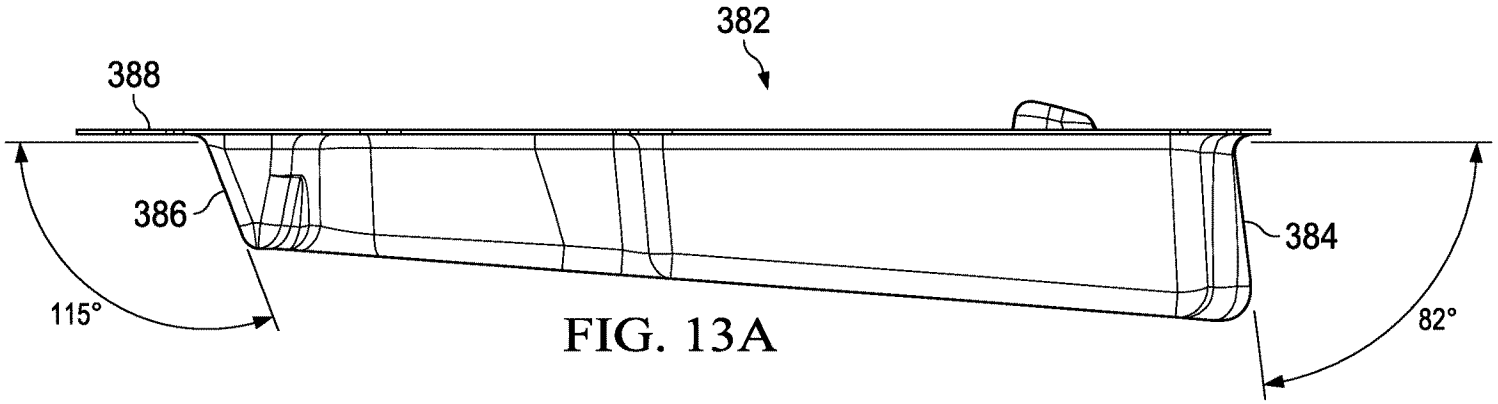
FIGS. 13A and 13B are side views of positioning a tub during manufacturing in accordance with an embodiment of the invention.
Figure 13B:
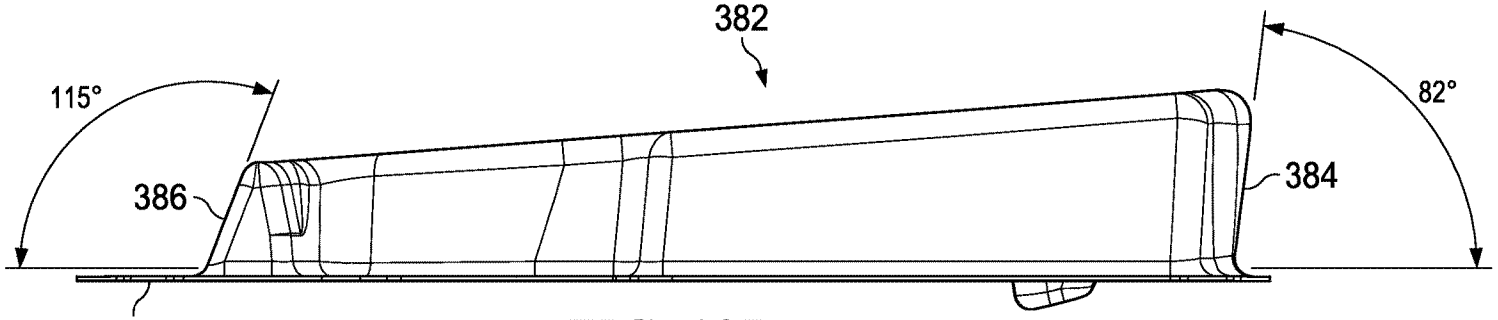
Figure 14A:
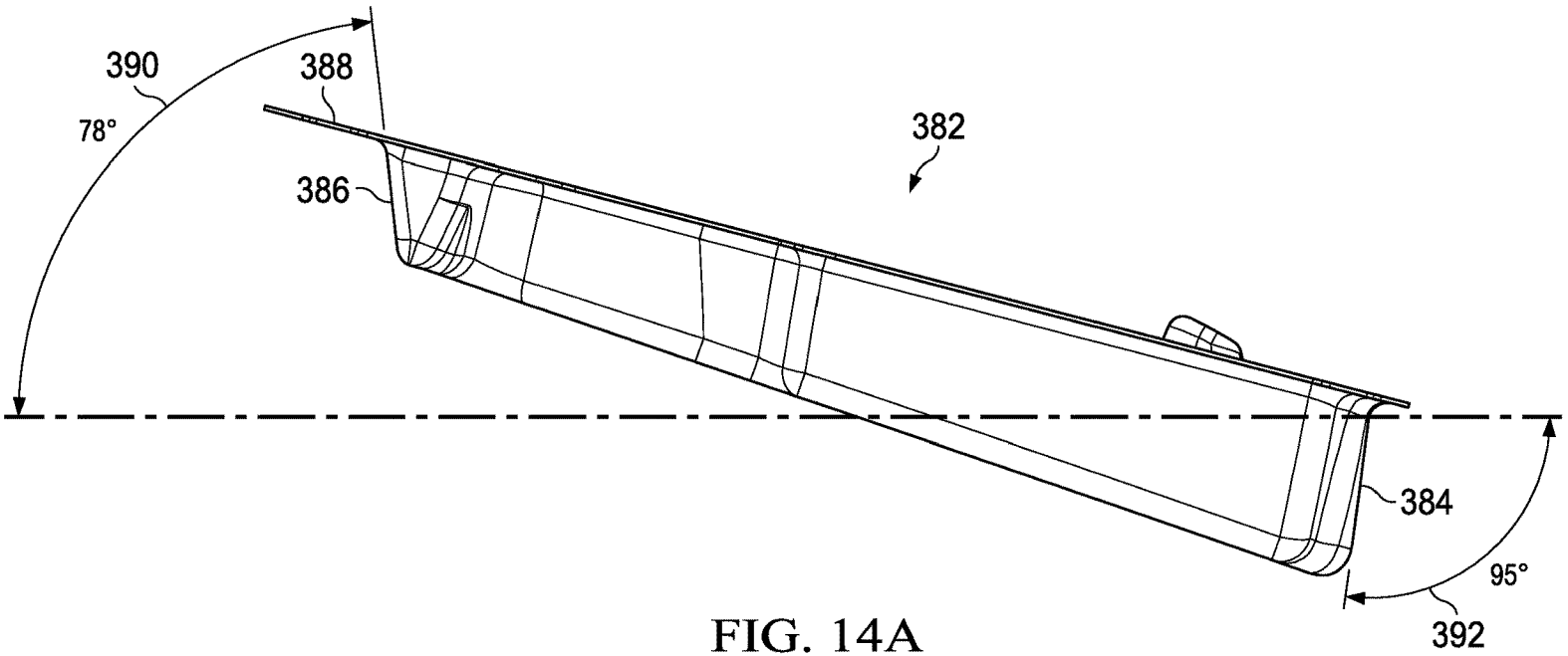
FIGS. 14A and 14B are side views of positioning a tub during manufacturing in accordance with an embodiment of the invention.
Figure 14B:
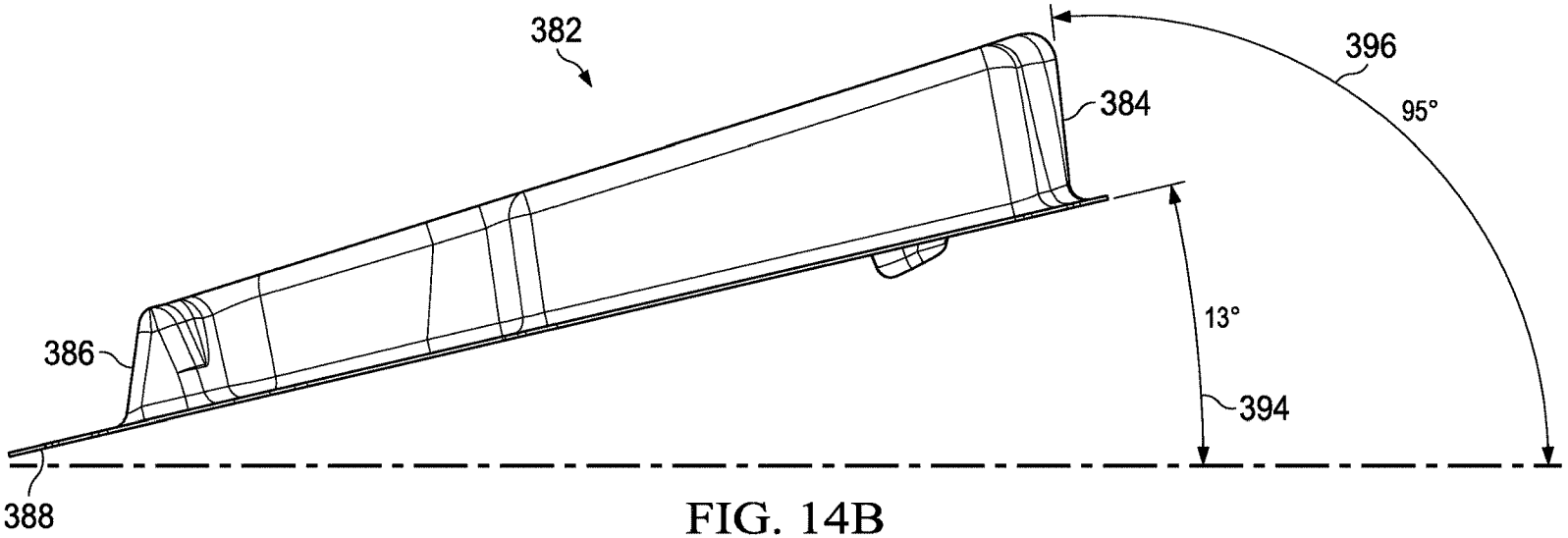

In an embodiment, the tubs of the present invention are molded, preferably integrally molded, e.g., such that the denesting features described herein may be integrally molded with the tub. Additionally or alternatively, the tubs can be formed from molding with additional features manufactured via secondary operation(s). Referring now to FIGS. 13A and 13B, a tub 382 can be formed by molding a material, as described herein, between a pair of toolings, e.g., a male tool and a female tool. The tub 382 can be molded such that a bottom exterior surface 384 of the tub has a reverse draft angle. In an embodiment, the reverse draft angle is about minus 5 degrees to about minus 15 degrees, preferably about minus 7 degrees to about minus 10 degrees, and more preferably about minus 8 degrees. The reverse draft angle of the bottom exterior surface 384 can help a consumer product package to stand when placed on a shelf, optionally, in conjunction with a flat portion of a bottom surface of a cover (e.g., a blister). Additionally or alternatively, a top exterior surface 386 is generally parallel with the bottom surface 384. In an embodiment, the top surface 388 of the tub is formed generally parallel with horizontal. For example, the pair of toolings can be oriented generally parallel with horizontal. It can be understood by one of ordinary skill in the art that the cavity of a tub can be oriented facing upwards or downwards depending on if a male tool or a female tool is used on the side on which the cavity is formed. Referring now to FIGS. 14A and 14B, the tub 382 is preferably molded, e.g., integrally molded, such that a pair of toolings is at an angle. Without intending to be bound by any theory, it is believed that forming the tub 382 at an angle may facilitate easier separation of the tub 382 from the molding, in particular for a tub 382 that has a reverse draft angle for the bottom surface 384. That is, it is believed that forming the tub 382 at an angle can allow a machine or a user to separate the tub 382 from straight from a tooling, vertically either up or down. Such a separation can be made easier so as to minimize the surface energy or forces required to lift the tub 382 with a reverse draft angle from the tooling. Shown in FIG. 14A is a tub 382 with a cavity facing upwards in which the tub 382 can be formed at an angle in which an angle 390 between a plane of the top exterior surface 386 and horizontal is about 65 degrees to about 85 degrees, preferably about 75 degrees to about 80 degrees, and even more preferably about 78 degrees. Moreover, an angle 392 formed between a plane of the bottom exterior surface 384 and horizontal can be about 85 degrees to about 100 degrees, preferably about 90 degrees to about 97 degrees, and even more preferably about 95 degrees. Shown in FIG. 14B is a tub 382 with a cavity facing downwards in which the tub 382 can be formed at an angle in which an angle 394 between a plane of the top surface 388 and horizontal is about 5 degrees to about 25 degrees, preferably about 10 degrees to about 13 degrees, and even more preferably about 13 degrees. Moreover, an angle 396 formed between a plane of the bottom exterior surface 384 and horizontal can be about 85 degrees to about 100 degrees, preferably about 90 degrees to about 97 degrees, and even more preferably about 95 degrees.

The demand for environmentally packaging materials is constantly increasing. Currently it is difficult to manufacture packages (e.g., blister packs) from environmentally packaging materials (e.g., paperboard or renewable plant fibers) with features to support the package in a vertical and substantially upright position. Unlike polymeric materials, materials such as paperboard or renewable plant fibers have manufacturing limitations which limit the shape and design of the package.

In one embodiment, the cover is sealed directly onto the portion of the outer flange formed by the polymeric laminate layer which in part forms the interior surface of the tub. Without intending to be bound by theory, it is believed that by removably sealing the cover onto the polymeric laminate layer, a strong seal can be achieved which is sufficiently resistant to air and water passage. In one embodiment, the strength of the seal between the cover and outer flange polymeric laminate layer forming is from about 6 to about 10 Newtons, or from about 7 to 8 Newtons preferably at least 6 Newtons. It is believed that comparable seals made directly to the cellulosic based substrate may not provide seal strength of up to 6 Newtons, possibly even as low as 3 Newtons. Furthermore, it may be preferable to use embodiments where the entire interior surface is formed of said polymeric laminate layer as this may allow for better sealing given any pulling force on the cover would be transferred to the touching outer flange polymeric laminate layer and at least in part transferred along other portions of the laminate layer forming the rest of the interior surface. It is believed that the rest of the polymeric laminate layer would provide a further "anchoring" effect as it increases the amount of contact between polymeric laminate layer and cellulosic based substrate. Of course, it is also within the scope of the invention for portions of the interior surface not to be coated with said laminate. In one embodiment, at least 50% by area, or at least 75%, or at least 95%, or at least 99%, up to 100% by area of the portion of the cellulosic based substrate facing the interior surface is coated with said polymeric laminate layer. In another embodiment, the entirety of the exterior surface of the cellulosic based substrate is such coated, or any of the ranges previously described in the preceding sentence. In an alternative embodiment to a laminate structure, any two or more of the layers may be adhered to one another via UV adhesive, cold glue, hot melt, etc.

Embodiments detailed herein may also combine elements or components of the invention which are disclosed in general but not expressly exemplified in combination unless otherwise stated herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A plurality of tubs for holding a consumer product comprising:

a first tub comprising a base and a perimeter wall defining a cavity, the base comprising at least two projections extending upward and away from the base within the cavity, the at least two projections spaced apart from the perimeter wall, at least one of the projections including a secondary projection disposed adjacent the at least one projection and extending upward and away from the base, the secondary projection having a height different than a height of each of the at least two projections, the secondary projection having a horizontal surface and a second tub comprising a base and a perimeter wall defining a cavity, the base comprising at least two projections extending upward and away from the base within the cavity, the at least two projections spaced apart from the perimeter wall, at least one of the projections including a secondary projection disposed adjacent the at least one projection and extending upward and away from the base, the secondary projection having a height different than a height of each of the at least two projections, the secondary projection having a horizontal surface, the horizontal surface of the secondary projection of the second tub having a different configuration than the horizontal surface of the secondary projection of the first tub such that when said first tub is stacked on said second tub with the secondary projections oriented in a same direction a portion of the horizontal surface of the secondary projection of the second tub is free from contact with the first tub.

2. The plurality of tubs of claim 1, wherein the secondary projection of the first tub is integrally formed with the base.

3. The plurality of tubs of claim 2, wherein the secondary projection of the first tub comprises a plurality of secondary projections, a height of each of the secondary projections being equal in height.

4. The plurality of tubs of claim 3, wherein each of the plurality of secondary projections of the first tub is spaced apart from one another.

5. The plurality of tubs of claim 1, wherein the first tub further comprises a top surface and the perimeter wall comprises an exterior surface, the exterior surface comprising opposing side walls each forming a non-perpendicular angle with the top surface.

6. The plurality of tubs of claim 5, wherein the opposing side walls of the first tub are generally parallel.

7. The plurality of tubs of claim 1, wherein one interior side wall of the perimeter wall of the first tub is non-linear.

8. The plurality of tubs of claim 7, wherein the one side of the perimeter wall of the first tub comprises a recessed portion having a height lower than a top surface of the first tub.

9. The plurality of tubs of claim 1, wherein each interior side wall of the perimeter wall of the first tub is non-linear.

10. The plurality of tubs of claim 1, wherein the first tub is made from fiber.

* * * * *